US012420138B1

(12) United States Patent
Gagnon

(10) Patent No.: US 12,420,138 B1
(45) Date of Patent: Sep. 23, 2025

(54) EXERCISE EQUIPMENT

(71) Applicant: Ab Coaster Holdings, Inc., Bernardsville, NJ (US)

(72) Inventor: Sean Gagnon, Lakewood Ranch, FL (US)

( * ) Notice: Subject to any disclaimer, the term of this patent is extended or adjusted under 35 U.S.C. 154(b) by 182 days.

(21) Appl. No.: 18/213,697

(22) Filed: Jun. 23, 2023

Related U.S. Application Data

(60) Provisional application No. 63/355,093, filed on Jun. 23, 2022.

(51) Int. Cl.

| | |
|---|---|
| ***A63B 23/035*** | (2006.01) |
| ***A63B 21/00*** | (2006.01) |
| ***A63B 21/04*** | (2006.01) |
| ***A63B 21/055*** | (2006.01) |
| ***A63B 21/068*** | (2006.01) |
| ***A63B 23/04*** | (2006.01) |
| ***A63B 71/00*** | (2006.01) |

(52) U.S. Cl.
CPC .. *A63B 23/03591* (2013.01); *A63B 21/00069* (2013.01); *A63B 21/0442* (2013.01); *A63B 21/0557* (2013.01); *A63B 21/068* (2013.01); *A63B 21/154* (2013.01); *A63B 21/4034* (2015.10); *A63B 21/4035* (2015.10); *A63B 23/04* (2013.01); *A63B 71/0054* (2013.01)

(58) Field of Classification Search
CPC ..... A63B 23/03591; A63B 21/00069; A63B 21/0442; A63B 21/0557; A63B 21/068; A63B 21/154; A63B 21/4034; A63B 21/4035; A63B 23/04; A63B 71/0054
See application file for complete search history.

(56) References Cited

U.S. PATENT DOCUMENTS

| | | | | | |
|---|---|---|---|---|---|
| 248,121 | A * | 10/1881 | Tuttle | A63B 21/0615 | 482/96 |
| 4,846,458 | A * | 7/1989 | Potts | A63B 21/4034 | 482/901 |
| 5,011,139 | A * | 4/1991 | Towley, III | A63B 21/0628 | 482/41 |
| 5,312,313 | A * | 5/1994 | Holmes | A63B 23/12 | 482/95 |
| 5,322,489 | A * | 6/1994 | Webb | A63B 21/068 | 482/133 |
| 5,499,959 | A * | 3/1996 | Holmes | A63B 23/12 | 482/93 |
| 6,702,724 | B2 * | 3/2004 | Taylor | A63B 23/0405 | 482/52 |

(Continued)

*Primary Examiner* — Andrew S Lo

(74) *Attorney, Agent, or Firm* — Kritzer McPhee LLP

(57) ABSTRACT

A machine, apparatus, and method for targeting the gluteal muscles. The exercise system includes a stationary left foot plate, a stationary right foot plate, and a mobile foot plate. The mobile foot plate is coupled to an arm and is configured to travel down and backward when pressed by a user's foot. An adjustable weight set is attached to the mobile foot plate and provides adjustable resistance when exercising. To exercise the gluteal muscles, the person stands with left or right foot on the corresponding stationary foot plate and places the other foot on the mobile foot plate. The person then drives the active foot downward and backward, then returns to the original resting position, thereby contracting and relaxing the gluteal muscles.

12 Claims, 4 Drawing Sheets

(56) References Cited

U.S. PATENT DOCUMENTS

| | | | | |
|---|---|---|---|---|
| 8,152,700 | B2 * | 4/2012 | Adams | A63B 21/0628 482/97 |
| 9,017,238 | B2 * | 4/2015 | Meredith | A63B 23/1218 482/142 |
| 2011/0028280 | A1 * | 2/2011 | Adams | A63B 21/4047 482/94 |
| 2012/0329626 | A1 * | 12/2012 | Meredith | A63B 71/0054 482/142 |
| 2020/0298042 | A1 * | 9/2020 | Hsieh | A63B 22/0056 |

* cited by examiner

EXERCISE EQUIPMENT

CROSS-REFERENCE TO RELATED APPLICATIONS

This application claims priority to U.S. Provisional Patent Application No. 63/355,093 filed on Jun. 23, 2022.

TECHNICAL FIELD

This application relates to exercise devices, and more particularly an exercise device for training gluteal muscles from a standing position.

BACKGROUND

The gluteal muscles are a group of three muscles which make up the buttocks. The three muscles include the gluteus maximus, gluteus medius, and gluteus minimus. The gluteal muscles control a person's thigh movement and aid in maintaining a person's balance, among many other purposes.

Traditional exercises to work the gluteal muscles, such as hip thrusts, step-ups, and Bulgarian split squats, are known to require balance and can place strain on the back. Thus, there is a material risk of injury when performing these exercises. To correct this problem, many devices and exercises have been created in an attempt to develop and maintain the gluteal muscles. These devices and exercises often produce motions which do not necessarily strengthen the gluteal muscles, or do so in a way that puts unnecessary strain on the exerciser's joints or leads to undesirable posture during exercise.

There is a need for an apparatus that guides an exerciser's leg movement downward and backward in a desirable path of motion. It would be beneficial to provide an apparatus that could enable an exerciser to execute the gluteal exercise with one leg while the upper body and non-mobile leg are supported in a biometrically desirable position. It would also be beneficial to provide an apparatus that could support an exerciser's upper body and non-mobile leg to reduce or substantially eliminate the need to focus on balance during the exercise.

SUMMARY

In accordance with one aspect of the present application, an exercise apparatus to work a person's gluteal muscles is presented. The exercise apparatus includes a mobile foot plate, a stationary left foot plate, a stationary right foot plate, and handles for a person's hands. The mobile foot plate is coupled to an arm and, during exercise, traverses back and forth along a predefined path. An adjustable set of weights is coupled to the mobile foot plate via a cable, thereby providing resistance during exercise.

To exercise the right gluteal muscles, the person stands with the left foot on the stationary left foot plate and places the right foot on the mobile foot plate. The person then drives the right foot downward and backward. To exercise the left gluteal muscles, the person stands with the right foot on the stationary right foot plate, places the left foot on the mobile foot plate, and drives the left foot down and backward.

BRIEF DESCRIPTION OF THE DRAWINGS

The detailed description makes reference to the accompanying figures wherein.

The figures are only intended to facilitate the description of the principles disclosed herein. The figures do not illustrate every aspect of the principles disclosed herein and do not limit the scope of the principles disclosed herein. Other objects, features, and characteristics will become more apparent upon consideration of the following detailed description.

DETAILED DESCRIPTION

A detailed illustration is disclosed herein. None of the terms used, including "plate," "arm, "cam," "bar," and "pulley," are meant to limit the application of the disclosed principles. Techniques, methods, processes, systems and operating structures in accordance with the principles disclosed herein may be embodied in a wide variety of forms and modes.

The exercise apparatus disclosed herein guides an exerciser's leg movement downward and backward in a desirable path of motion. The exercise apparatus enables an exerciser to execute a gluteal exercise with one leg while the upper body and non-mobile leg are supported in a biometrically desirable position. The exercise apparatus supports the exerciser's upper body and non-mobile leg to reduce or substantially eliminate the need to focus on balance during the exercise.

Figure 1:
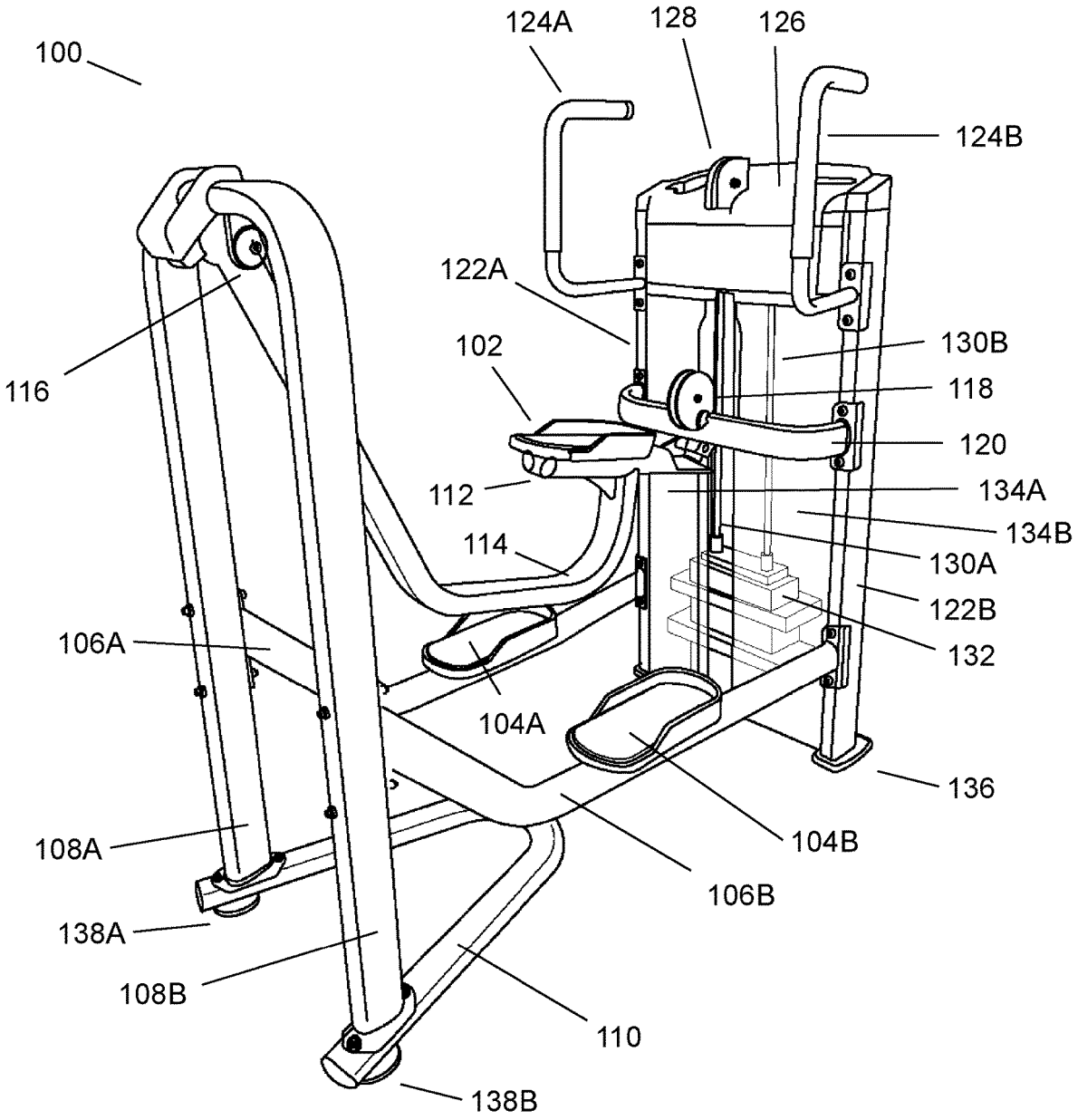
FIG. 1 illustrates an exercise apparatus in accordance with the principles disclosed herein.

FIG. 1 shows an exercise apparatus 100, with mobile foot plate 102 secured to plate mount bar 112, which is secured to arm 114. Arm 114 is coupled at cam 116 to left support bar 108A and right support bar 108B. As shown, floor bar 110 is coupled to, and provides structural support for, left support bar 108A and right support bar 108B. Left pad 138A and right pad 138B are coupled to floor bar 110 and are preferably cushioned to avoid scratches or other damage to the surface underneath exercise apparatus 100.

Towards the front of exercise apparatus 100 are left support bar 122A and right support bar 122B, each of which is coupled to horizontal bar 120 and panel 126. Right pad 136 is coupled to right support bar 122B, and another pad (not shown) is coupled to left support bar 122A. Left handle 124A is mounted on left support bar 122A, and right handle 124B is mounted on right support bar 122B. Left foot plate 104A is mounted on left support bar 106A, which is coupled on one end to left support bar 122A and is coupled on the opposite end to left support bar 108A. Right foot plate 104B is mounted on right support bar 106B, which is coupled on one end to right support bar 122B and is coupled on the opposite end to right support bar 108B.

A cable (not shown) is coupled on one end to mobile foot plate 102 runs along pulley 118 up to and around pulley 128 and down to weights 132. In the embodiment shown, the cable is secured to an apparatus (such as a vertical bar with holes) that optionally holds a selectable amount of weights (for example, by inserting a pin through a desired weight), so that when the cable is pulled by mobile foot plate 102, the selected weights 132 are raised upward. Weights 132 are positioned along left weight rail 130A and right weight rail 130B, which limit horizontal movement while allowing weights 132 to freely travel upward and downward. Left panel 134A and right panel 134B are provided to shield weights 132 from a user, thereby decreasing the risk of something interfering with or getting caught in weights 132 during use.

Figure 2:
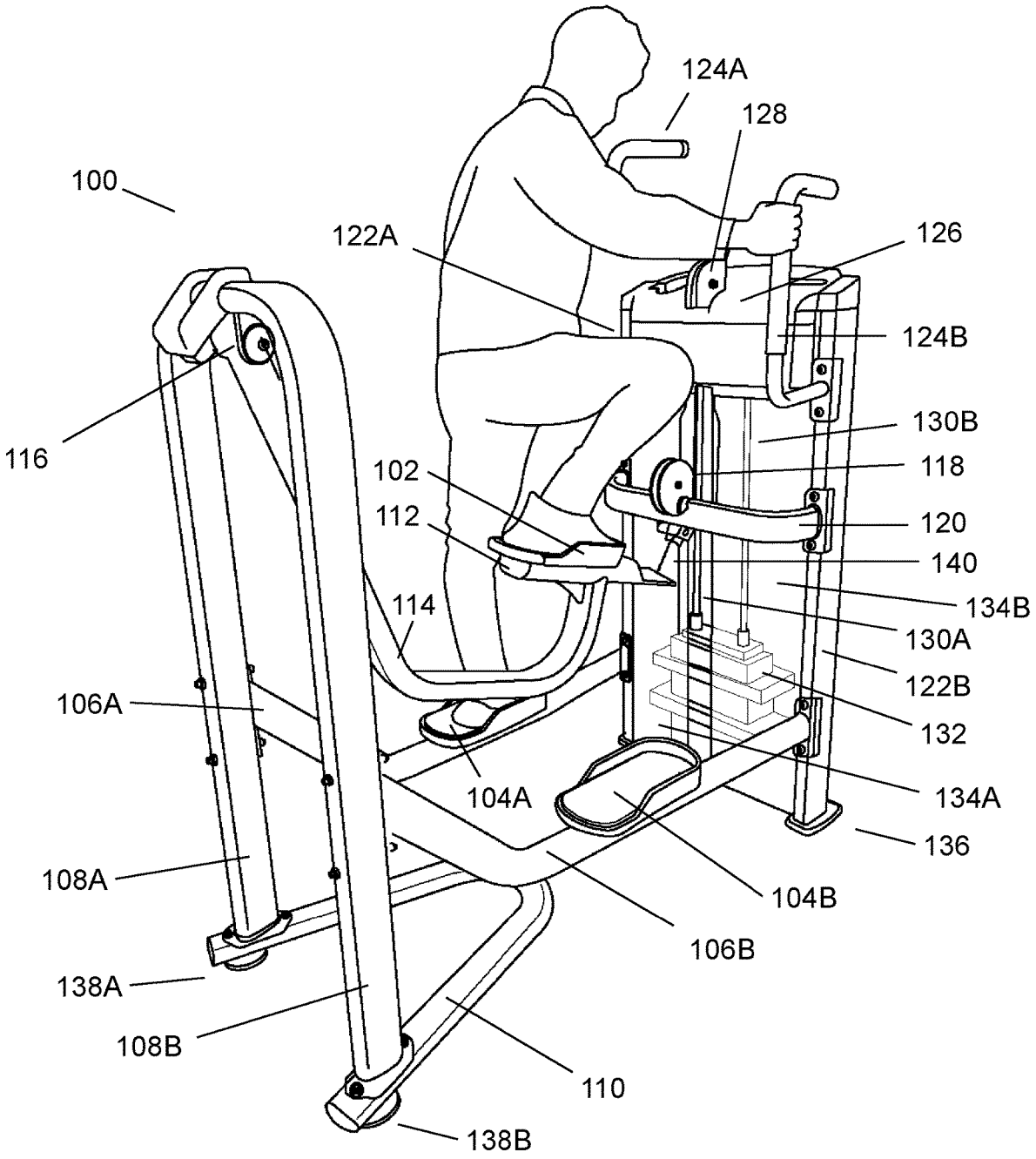
FIG. 2 illustrates the exercise apparatus of FIG. 1 with an exerciser in a first position.

FIG. 2 shows a person standing with the left foot on left foot plate 104A and the right foot on mobile foot plate 102. To exercise the right gluteal muscles, the person drives the right foot downward and backward along a path determined by the shape of arm 114 and position of cam 116. As the person pushes down on mobile foot plate 102, cable 140 is pulled with it, thereby lifting the selected weights 132. By extending the right foot downward and backward, the person contracts the right gluteal muscles. The person then relaxes the right gluteal muscles when returning the right foot back to the original relaxed position. To exercise the left gluteal muscles, the person places the right foot on right foot plate 104A, places the left foot on mobile foot plate 102, and drives the left foot down and backward. Regardless of which leg is being exercised, it is advisable that the person holds left handle 124A with the left hand and holds right handle 124B with the right hand.

Figure 3:
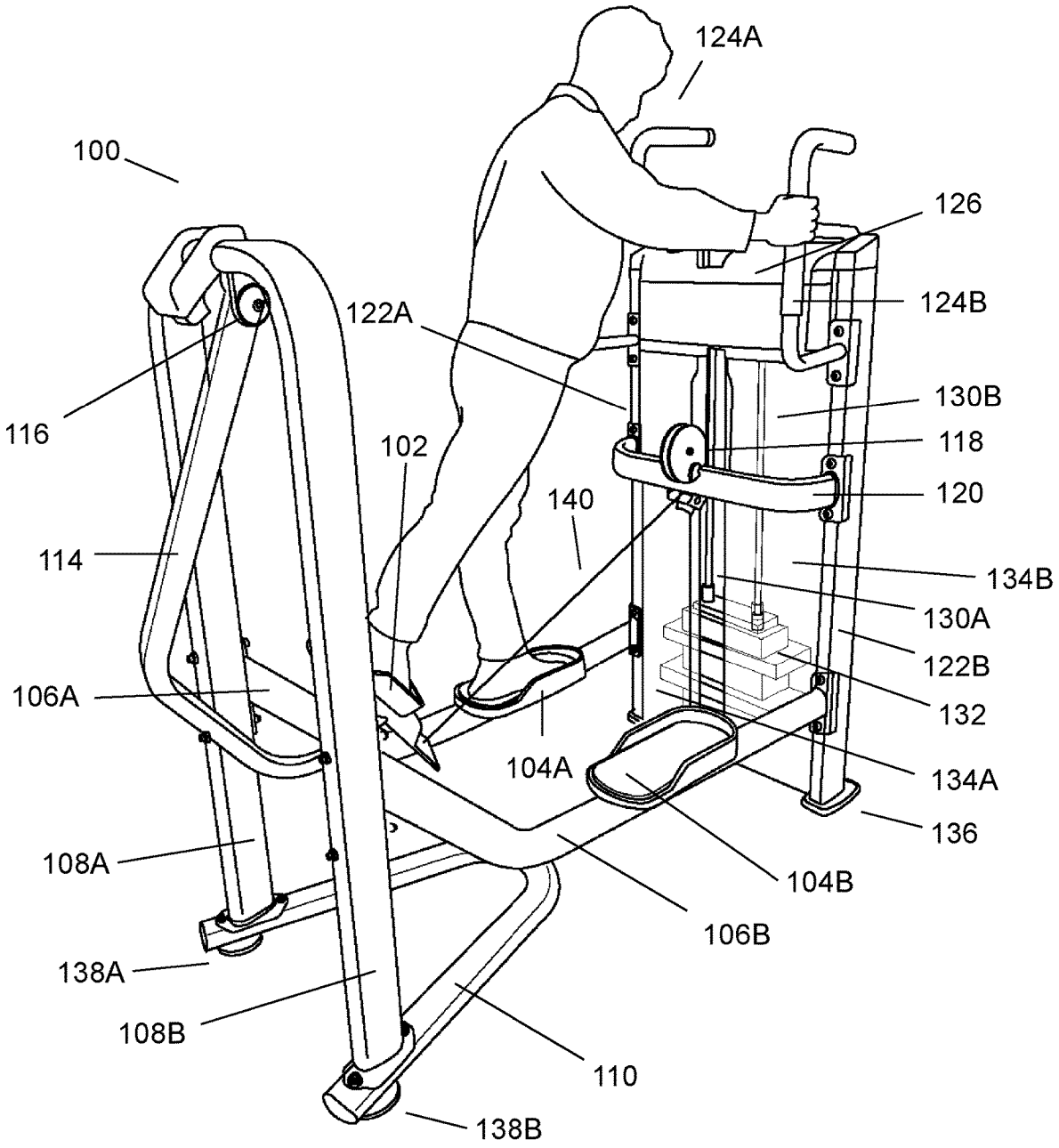
FIG. 3 illustrates the exercise apparatus of FIG. 1 with an exerciser in a second position.

FIG. 3 shows the person with the right leg fully extended, displaying the range of motion available for exercise. As shown, weights 132 are optionally not engaged with cable 140, and so weights 132 are not lifted from their resting position when mobile foot plate 102 is moved down and backward. By selecting one or more of weights 132 before exercising, the person can increase the resistance experienced when pressing down and backward on mobile foot plate 102.

In one embodiment, a third pulley is coupled to the apparatus that holds the weights (such as a vertical bar with holes). The cable runs around the third pulley, and the end of the cable is secured at or near the top of the exercise apparatus, such as behind panel 126. In this embodiment, when the cable is pulled back during exercise, the selected weights travel a shorter distance than the mobile foot plate. This design allows for a longer range of motion for the mobile foot plate and/or a shorter range of motion required for the selected weights.

In some embodiments, one or more forearm supports are used in place of, or in addition to, left handle 124A and right handle 124B.

The size and shape of arm 114, the size and shape of left support bar 108A, and right support bar 108B, and the cam 116, all may be configured to provide a desired range of motion for mobile foot plate 102 with respect to left foot plate 104A and right foot plate 104B.

In some embodiments, the size and shape of arm 114, left support bar 108A, and right support bar 108B can be configured so that a user is able to stand with the stationary foot on the floor while exercising.

In some embodiments, higher or lower resistance may be provided by modifying cam 116 to either resist or facilitate movement of arm 114.

In some embodiments, one or more pins may be added to arm 114 to, for example, hold weights or attach to resistance bands. Through the use of weights, resistance bands, or other accessories, such pin(s) can be used to increase or decrease the resistance experienced by the person, and may even be used to provide increased or decreased resistance for a subset of the range of motion of mobile foot plate 102.

In some embodiments, the left and right handles 124A and 124B may be fixed at an angle, and in some embodiments, they may be repositionable by a user and fixed at a desired position.

In some embodiments, cable 140 is coupled to mobile foot plate 112 on one side and extends to and around pulley 128 without passing by through pulley 118.

In some embodiments, mobile foot plate 102 is mounted directly onto arm 114 without the use of a plate mount bar.

In some embodiments, one weight rail is used to guide the movement of weights 132. In some embodiments, alternatives to stackable weights may be used to provide resistance to the movement of cable 140.

In some embodiments, a safety bar is coupled to left support bar 108A and right support bar 108B and which provides a visual indicator of how far back arm 114 may extend during use. A safety bar may also be configured to serve as a physical barrier to prevent someone from being struck by arm 114 when it is extended backwards beyond left support bar 108A and right support bar 108B.

In some embodiments, left support bar 108A and right support bar 108B may be formed as a single unit, and in other embodiments, they may be formed separately and coupled together. In some embodiments, left support bar 122A and right support bar 122B may be formed as a single unit, and in other embodiments, they may be formed separately and coupled together.

Figure 4:
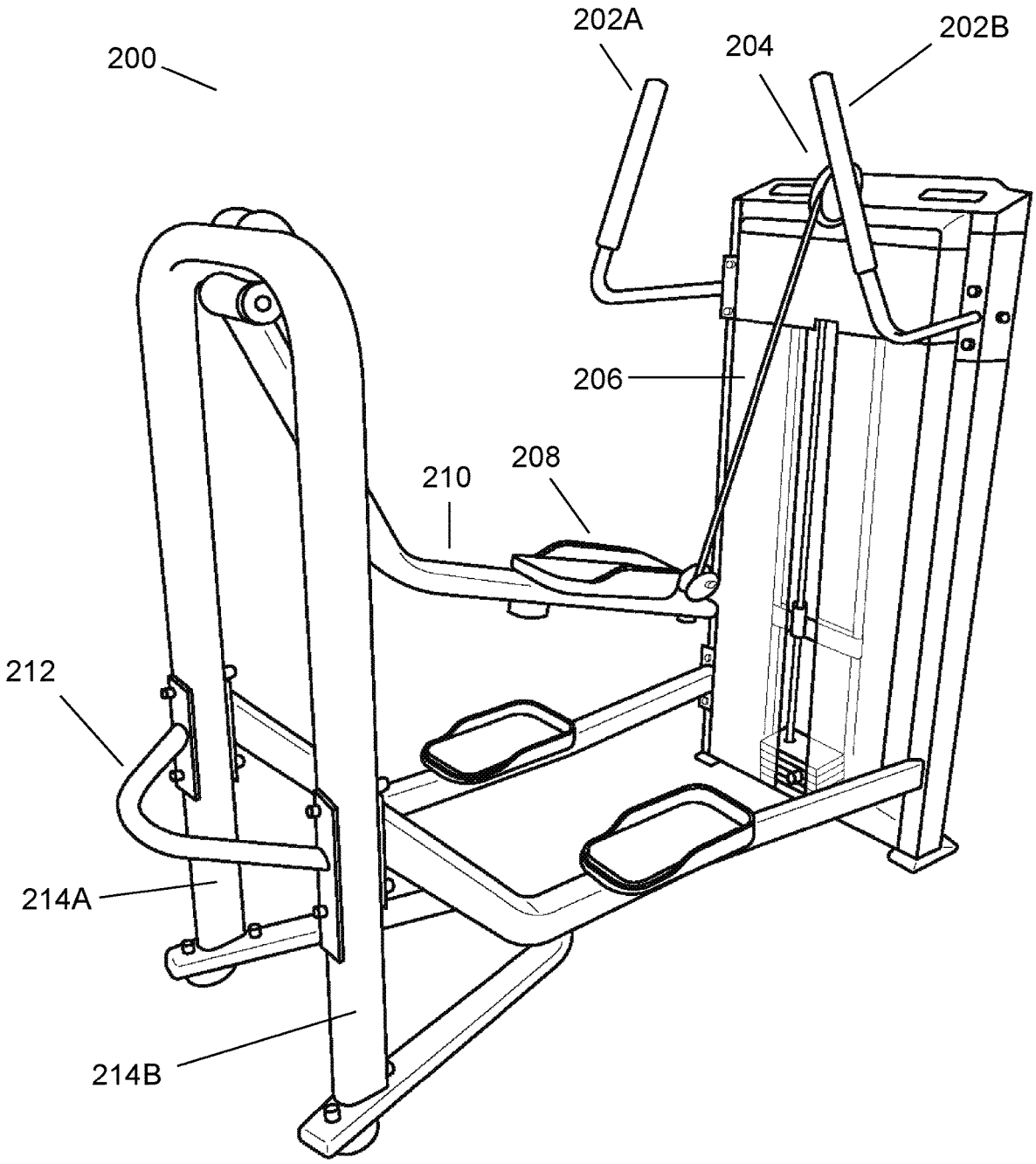
FIG. 4 illustrates an exercise apparatus in accordance with the principles disclosed herein.

FIG. 4 shows an exercise apparatus 200 comprising some of the features described above. Left handle 202A and right handle 202B are angled inward to provide a potentially more comfortable position for a user's hands and arms while exercising. Mobile foot plate 208 is coupled to arm 210. Cable 206 is coupled to arm 210 on one end, passes around pulley 204 and is coupled to one or more weights in a weight stack at its opposite end. A single curved bar extends to form left support bar 214A and right support bar 214B. Safety bar 212 is coupled to left support bar 214A and right support bar 214B and extends outward to provide a visual and physical indicator of how far back arm 210 may extend during use.

The detailed description is not intended to be limiting or represent an exhaustive enumeration of the principles disclosed herein. It will be apparent to those of skill in the art that numerous changes may be made in such details without departing from the spirit of the principles disclosed herein.

What is claimed is:

1. An exercise apparatus comprising:

a frame comprising a first rear vertical support bar, a second rear vertical support bar, a first front vertical support bar, a second front vertical support bar, a first lateral support bar coupled to the first rear vertical support bar and the first front vertical support bar, and a second lateral support bar coupled to the second rear vertical support bar and the second front vertical support bar;

an arm rotatably coupled at one end to the first rear vertical support bar and the second rear vertical support bar;

a pulley coupled to the first front vertical support bar and the second front vertical support bar;

a cable coupled at one end to the arm and coupled at the opposite end to one or more weights, the cable in contact with the pulley;

a mobile foot plate coupled to the arm;

a first stationary foot plate coupled to the first lateral support bar; and a second stationary foot plate coupled to the second lateral support bar.

2. The exercise apparatus of claim 1, further comprising:

a first handle coupled to the first front vertical support bar; and a second handle coupled to the second front vertical support bar.

3. The exercise apparatus of claim 2, wherein the first handle and the second handle are configured to be repositioned and secured in a new position.

4. The exercise apparatus of claim 1, further comprising a floor bar coupled to the first rear vertical support bar and the second rear vertical support bar.

5. The exercise apparatus of claim 1, further comprising at least one weight rail configured to guide the movement of the one or more weights.

6. The exercise apparatus of claim 1, further comprising a safety bar coupled to the first rear vertical support bar and the second rear vertical support bar.

7. The exercise apparatus of claim 1, further comprising a second pulley in contact with the cable.

8. The exercise apparatus of claim 1, further comprising a cam coupled to the arm and coupled to the first rear vertical support bar and the second rear vertical support bar, the cam configured to provide resistance to the movement of the arm.

9. The exercise apparatus of claim 1, further comprising:

a first handle coupled to the first front vertical support bar;

a second handle coupled to the second front vertical support bar;

a floor bar coupled to the first rear vertical support bar and the second rear vertical support bar; and a safety bar coupled to the first rear vertical support bar and the second rear vertical support bar.

10. The exercise apparatus of claim 9, further comprising at least one weight rail configured to guide the movement of the one or more weights.

11. The exercise apparatus of claim 9, further comprising a second pulley in contact with the cable.

12. The exercise apparatus of claim 9, further comprising a cam coupled to the arm and coupled to the first rear vertical support bar and the second rear vertical support bar, the cam configured to provide resistance to the movement of the arm.

* * * * *